United States Patent [19]

Karaki et al.

[11] 4,431,319

[45] Feb. 14, 1984

[54] METHOD AND APPARATUS FOR SERIAL DOT PRINTING

[75] Inventors: Nobuo Karaki; Teruyuki Nakaya, both of Shiojiri, Japan

[73] Assignee: Epson Corporation, Nagano, Japan

[21] Appl. No.: 293,438

[22] Filed: Aug. 17, 1981

[30] Foreign Application Priority Data

Aug. 18, 1980 [JP] Japan ..... 55-113193

[51] Int. Cl.[3] ..... B41J 3/12

[52] U.S. Cl. ..... 400/124; 101/93.05

[58] Field of Search ..... 101/93.04, 93.05; 400/121, 124

[56] References Cited

U.S. PATENT DOCUMENTS

| | | | |
|---|---|---|---|
| 3,759,359 | 9/1973 | Stellmach | 197/1 R |
| 3,900,094 | 8/1975 | Larsen | 197/1 R |
| 3,931,761 | 1/1976 | Carrus et al. | 400/121 X |
| 4,086,997 | 5/1978 | Wu | 400/57 |
| 4,159,882 | 7/1979 | Sanders et al. | 101/93.05 X |
| 4,204,090 | 5/1980 | Heinzl | 178/30 |
| 4,242,003 | 12/1980 | Ragen | 400/124 |
| 4,256,408 | 3/1981 | Shelton | 400/124 |
| 4,284,363 | 8/1981 | Choberka | 400/124 |

FOREIGN PATENT DOCUMENTS

| | | | |
|---|---|---|---|
| 2535699 | 3/1977 | Fed. Rep. of Germany | 400/124 |
| 55-48003 | 3/1980 | Japan | 400/121 |
| 1131891 | 10/1968 | United Kingdom | 400/121 |

OTHER PUBLICATIONS

J. E. Lisinski and D. K. Rex, Print Head Dipper, IBM Technical Disclosure Bulletin, vol. 20, No. 12 (May 1978).

*Primary Examiner*—Paul T. Sewell

*Attorney, Agent, or Firm*—Blum, Kaplan, Friedman, Silberman & Beran

[57] ABSTRACT

A serial dot printer provides a high quality printed product by printing on demand the same alphanumeric characters and symbols twice with a vertical distance between the first and second printing corresponding to half of the vertical pitch distance of the dots in the first printing. Normal line spacing is provided for both single and double printing.

8 Claims, 11 Drawing Figures

METHOD AND APPARATUS FOR SERIAL DOT PRINTING

BACKGROUND OF THE INVENTION

This invention relates generally to a method and apparatus for serial dot printing and more particularly to a method and apparatus for serial dot printing producing printing indicia of high quality. Each alphanumeric character and symbol is formed by a combination of dots. It is well known that a printer of this type can form various characters and symbols by selecting suitable dot patterns in, for example, a 5×7 or 7×9 dot matrix. A 24×24 dot matrix may be used for Chinese characters which require many combinations of dots. Such a 24×24 matrix is conventionally formed by arranging twenty-four wires in a linear row, for example, vertically and moving a paper sheet orthogonally thereto for the purpose of printing on the paper sheet.

The use of such a dot matrix printer to form characters and symbols is widespread due to the fact that it is possible to form a wide selection of alphanumeric characters and symbols while using only a limited number of wires. It is not necessary to prepare fixed fonts. However, the readability of the alphanumeric characters and symbols formed by dot printing is not of excellent quality when compared with those characters printed by means of fonts. For this reason, such a dot printer has not been considered suitable in preparing official dcuments and legal documents.

An approach for the improvement in appearance of the alphanumeric characters and symbols formed by a dot matrix printer is disclosed in U.S. Pat. No. 3,900,094. In this patent, adjacent dots are overlapped to approximate a solid line by two rows of wires arranged in a staggered pattern. In U.S. Pat. No. 4,159,882, curved or wavy portions of a printed character or symbol are smoothed by a plurality of lateral traverses of the print head combined with incremental vertical motion of the print head such that different portions of the character or symbol are printed in each traverse until the character is entirely formed. A modification of the latter approach is disclosed in U.S. Pat. No. 4,242,003 wherein different data is printed on each of two lateral passes of the print head per line of print produced. The print head and recording medium are moved relative to each other in the vertical direction between each lateral traverse.

In printing methods of the prior art, dots are printed in half space positions, which smooths the curved portions and oblique slanted lines of a character. However, as illustrated by U.S. Pat. No. 4,159,882, the head must move across the paper several times and the pins or wires in the head which are driven during each traverse are different. Therefore, different driving signals for driving the plurality of pins or wires in each traverse must be provided. The changed driving signals in each traverse are in response to segregated data on the dots to be printed for forming the character in each traverse. Therefore, the control circuitry to provide the unique data for each traverse becomes sophisticated and complicated.

What is needed is a method and apparatus for serial dot printing which provides characters of very high quality using a simple apparatus with an uncomplicated control and data system.

SUMMARY OF THE INVENTION

Generally speaking, in accordance with the invention, a method and apparatus for serial dot printing especially suitable for the production of a high quality printed product is provided. The serial dot printer in accordance with this invention provides a high quality printed product by twice printing the same alphanumeric characters and symbols in dots with a slight positional offset. A vertical distance is provided between the first and second printing corresponding to half of the vertical pitch distance between dots in the first printing. Thus, the space between the dots which results from the space between the wires in the print head is better filled. Normal line spacing is provided for both single and double printing of characters and symbols. By having the print paper transported by less than the pitch distance between lines after a line has been first printed in the double printing technique, the printed dots are connected together without need for a sophisticated control circuit and the printing quality approximates that of font characters. The dot information necessary for forming one character or symbol by the firing of pins or wires in a first traverse is used a second time after the recording sheet is fed by ½ of the vertical dot pitch distance. The same pins and wires are driven by the same data in the second traverse as in the first traverse.

Accordingly, it is an object of this invention to provide an improved method and apparatus for serial dot printing which provides a high quality printed product similar to that produced by font characters.

Another object of this invention is to provide an improved method and apparatus for serial dot printing which uses a simple linear array of dot producing elements.

A further object of this invention is to provide an improved method and apparatus for serial dot printing which operates with simple data storage techniques and a simple control circuit.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
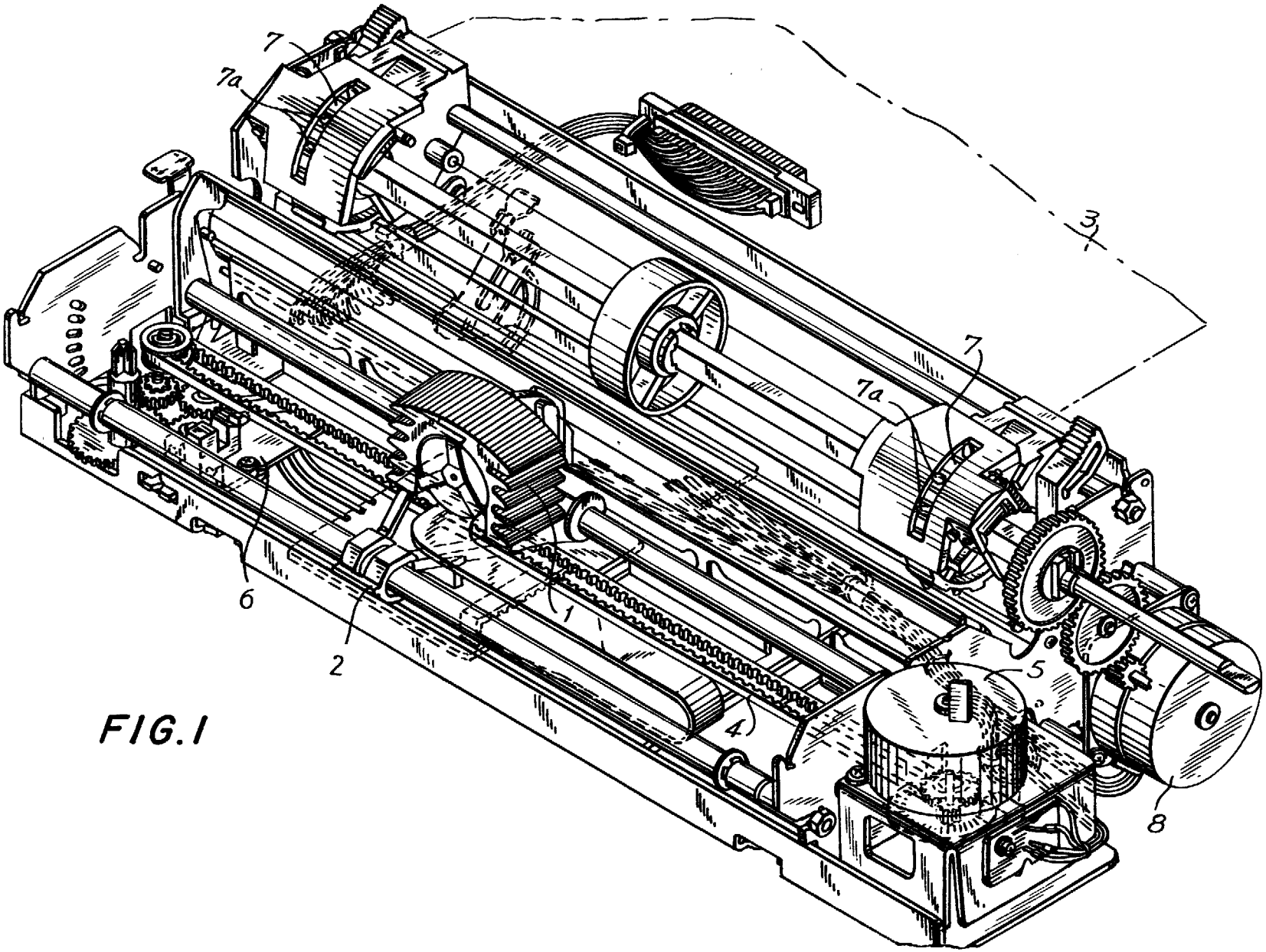
FIG. 1 is a top perspective view of the mechanism of a serial dot printer in accordance with this invention.

FIG. 1 is a perspective view of a dot printer mechanism in accordance with this invention. In FIG. 1, a printing head 1 includes a vertical array of a plurality of wires, not visible in FIG. 1, and electromagnetic structures of the clapper type provided for driving the respective wires in the known manner. The print head 1 is mounted on a carriage 2 and is driven in a traversing direction with respect to a recording sheet 3. That is, the printing head 1 moves laterally in a direction tranverse to the extended length of the recording sheet. The driving force translating the print head 1 across the width of the recording sheet 3 is supplied through a timing belt 4 by a stepping motor 5 to which the timing belt 4 is connected. Generally, the carriage 2 is biased toward either one of a pair of frames on opposite sides of the printer mechanism and a reference position of the carriage 2, from which a printing traversing motion is started, is precisely controlled by a home-position detector 6.

The recording sheet 3 is provided along each side edge thereof with a row of perforations (not shown) which are engaged with protrusions 7*a* of sprocket wheels 7. The protrusions 7*a* advance in steps with rotation of the sprocket wheels 7. Driving power for the sprocket wheels is derived from a stepping motor 8 which thus serves to feed the recording sheet 3.

Although an ink ribbon is omitted in the structure showing FIG. 1, it should be apparent that an ink ribbon may be arranged between the print head 1 and the recording sheet 3. The ribbon serves to provide clear dots on the recording sheets when the wires are actuated. The mechanism of the printer of FIG. 1 is an example and there are many other printers having different mechanisms to which the present invention is applicable. For example, an ink jet type printer or a thermal printer can be adapted in accordance with this invention. In these latter type printers, it may be necessary to slightly modify the structure of the printing head to adapt to this invention.

Figure 2:
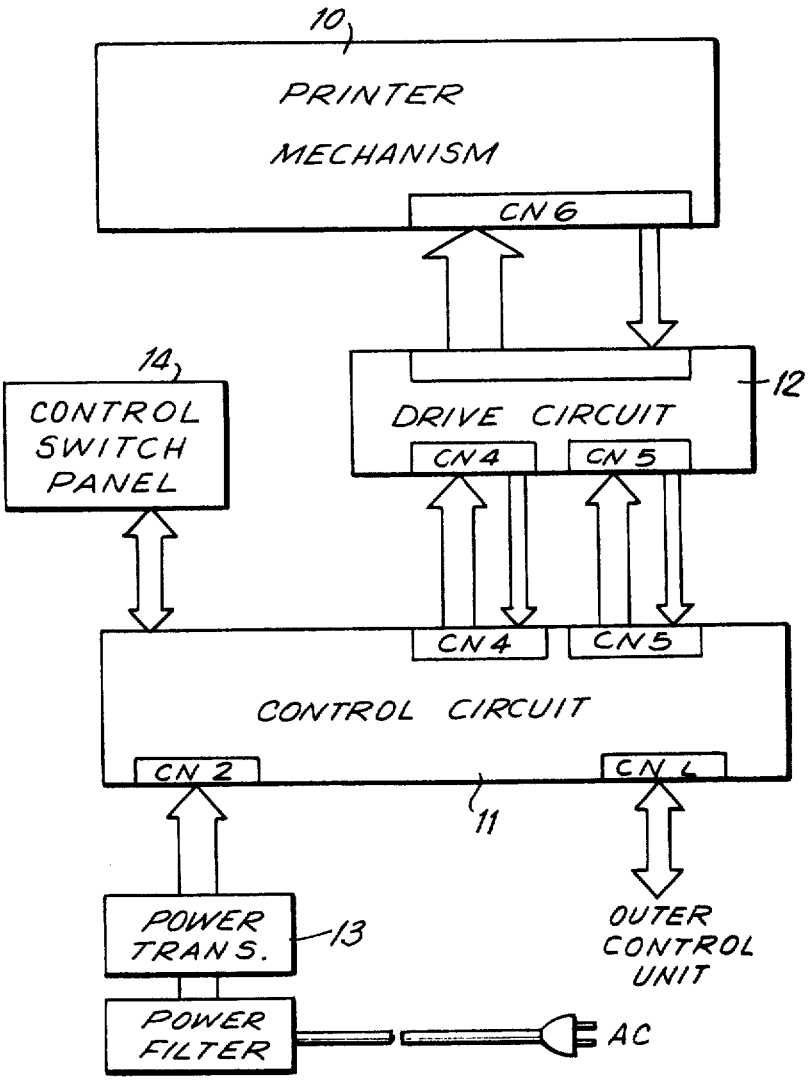
FIG. 2 is a functional block diagram of the serial printer of FIG. 1.
Figure 3:
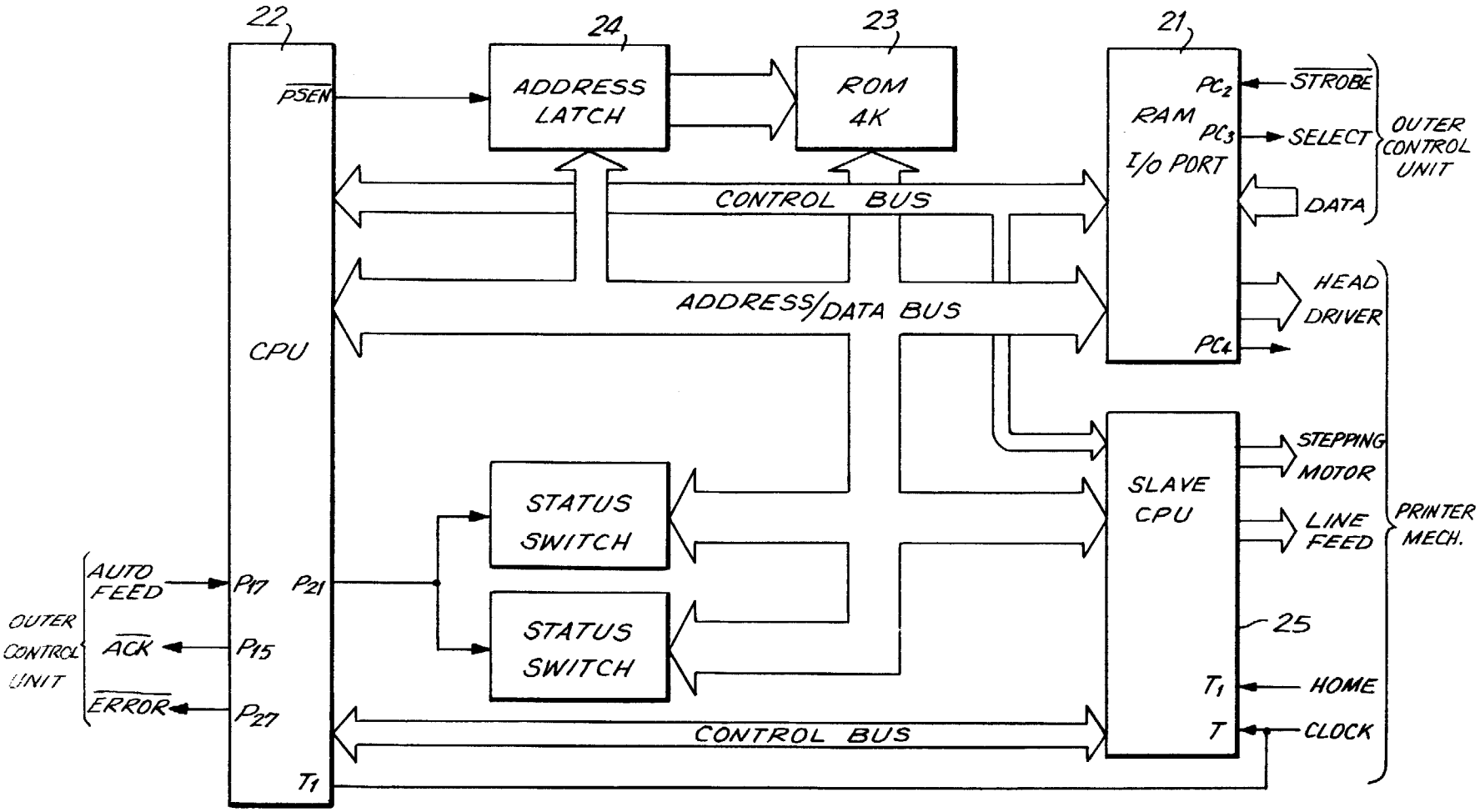
FIG. 3 is a more detailed block diagram of the control portion of the diagram of FIG. 2.
Figure 4:
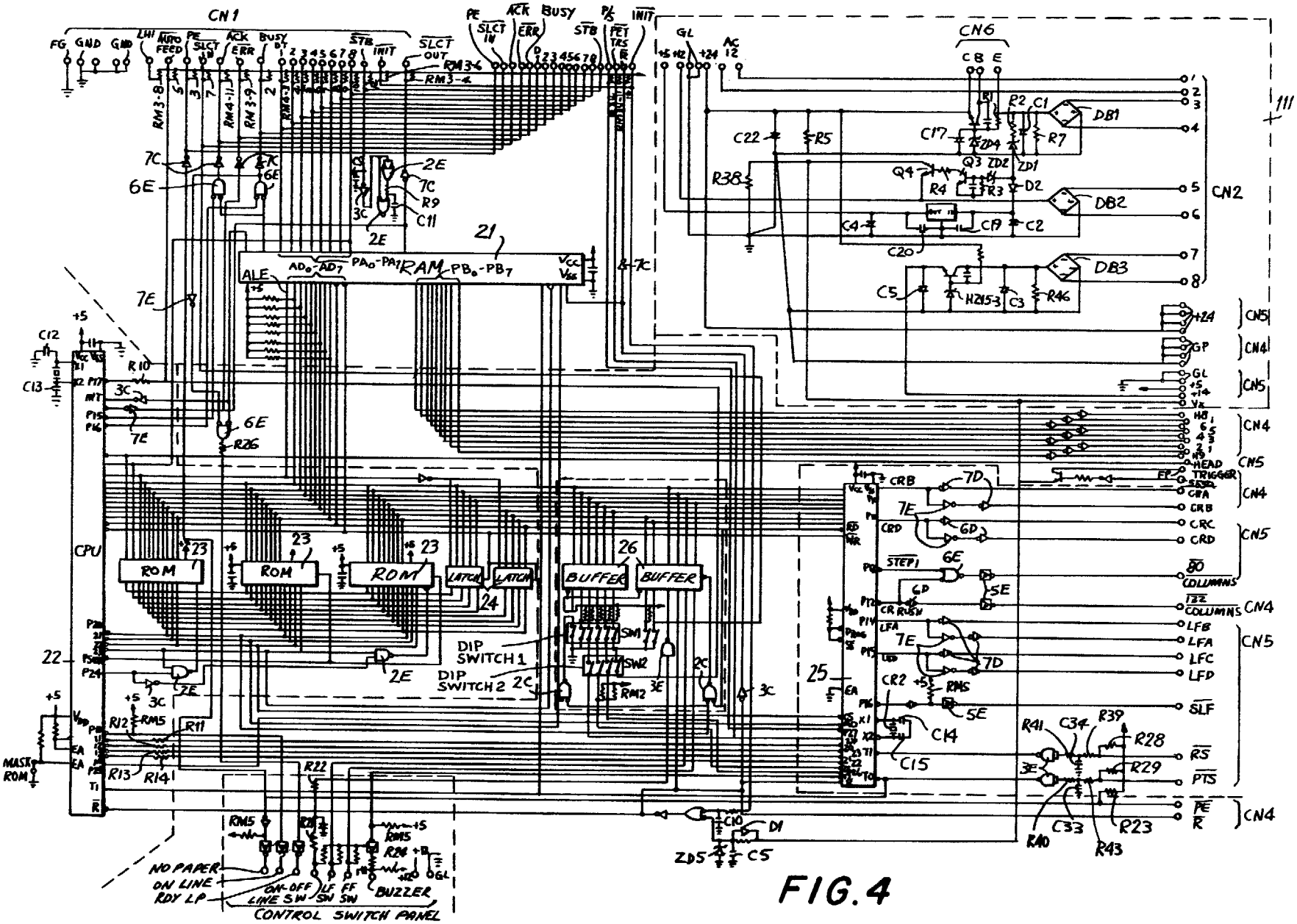
FIG. 4 is a circuit diagram of the control circuit of FIG. 3.
Figure 5:
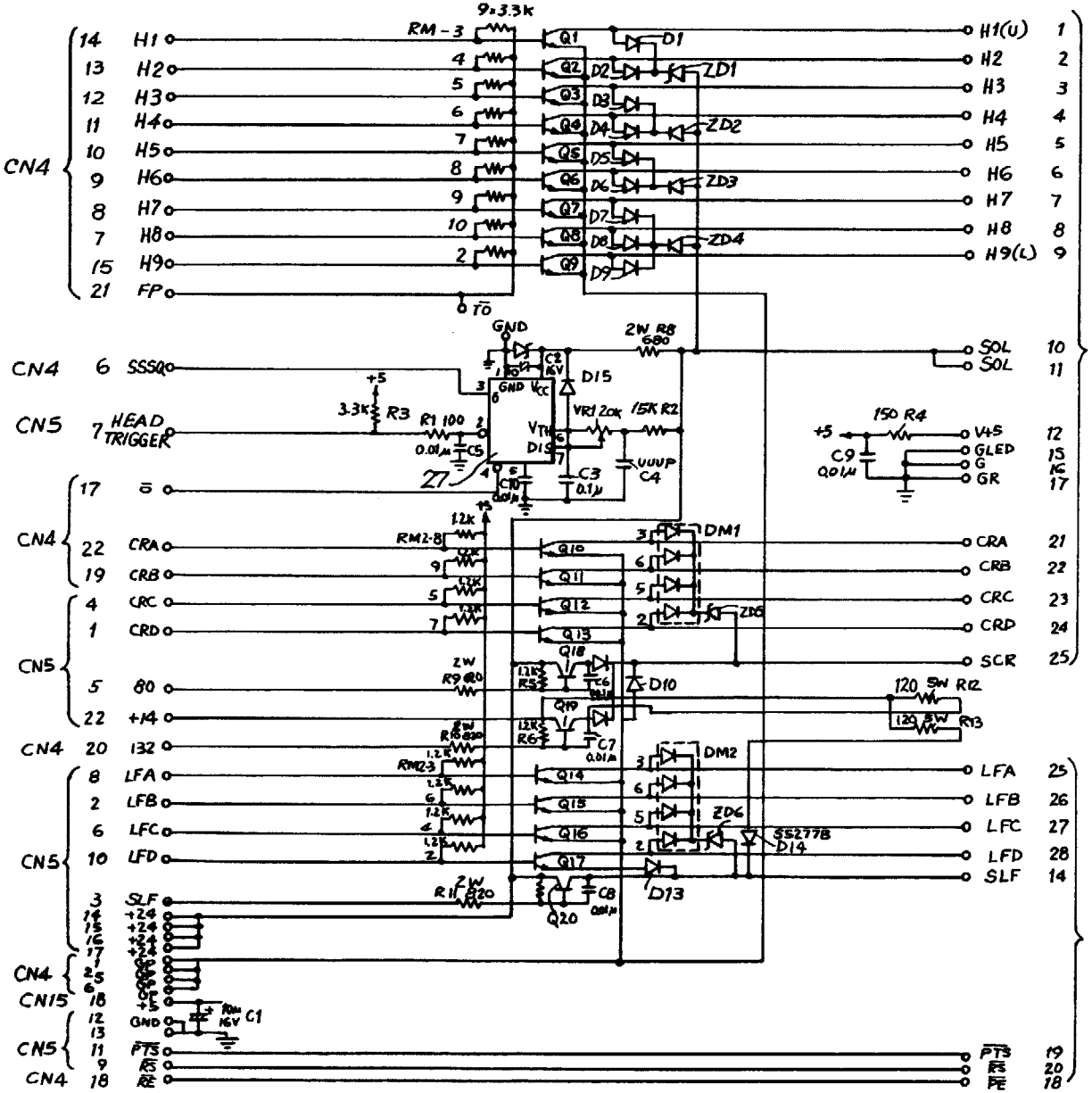
FIG. 5 is a circuit diagram of the drive circuit of FIG. 3.

FIG. 2 is a functional block diagram of a serial dot printer in accordance with this invention with signals flowing between a printer mechanism 10, a control circuit 11, a driving circuit 12 and control switch panel 14. FIG. 3 is a more detailed block diagram of the control circuit of FIG. 2. FIGS. 4 and 5 are actual circuit diagrams of the control circuit 11 and the driving circuit 12 of FIGS. 2 and 3 respectively.

In these Figures, a power supply portion 111 (FIG. 4) of the control circuit 11 includes a transformer 13, a rectifier and voltage regulator from which voltages are applied to various circuit portions of the drive and control systems. In the illustrated embodiment, +24 volts DC is provided for driving head magnets and stepping motors. Also, +5 volt DC is provided for TTL logic and +12 volts DC is provided for buzzer and photoemissive diodes, etc. A 14 volt DC line is provided for holding the stepping motor for the carriage, and an optional 12 volts AC is provided for serial interfaces, etc.

Further, in this embodiment, any abnormality of the supply voltages is detected so as to reset the control circuit to its original state. Thereby, application of voltage to the driving transistors for the head magnets is suspended so that the application of abnormal voltages to the magnets for the print head is prevented. That is, when the sum of the 12 volt supply in this embodiment and the 7 volt supply exceeds a rated value, that is, 19 volts, base current is supplied to a transistor $Q_3$ causing another transistor $Q_4$ to be turned ON, thereby applying 12 volts to the head driving circuit. The 12 volt source is applied to a Zener diode $ZD_1$ connected to an output of a rectifier for the 24 volt system. The 7 volt supply is applied to a Zener diode $ZD_2$ connected to the base of the transistor $Q_3$.

When for some reason, the voltage in the 24 volt system becomes lower than 19 volts, the transistor $Q_4$ is turned off and thus, the 12 volt supply is not applied to the base of the transistor of the head driving circuit. Thus, the head magnet is inoperative which prevents the wires of the print head from being damage from operation with unsuitable voltage levels.

The 24 volts supply is obtained from a series regulator comprised principally of a Zener diode $ZD_4$ and a transistor $Q_1$ after full wave rectification. The 5 volt supply is applied to a logic circuit and is derived from a three terminal regulator $SR_2$. The overall features of the control system will be apparent to those skilled in the art upon examination of FIGS. 2 through 5. However, briefly described, the exchange of data and signals with respect to an outer control unit is performed by a RAM 21 having input/output (I/O) ports. The RAM 21 operates upon commands from a microprocessor (CPU) 22 which provides the main control. In the diagram of FIG. 3, a port $PC_2$ of the RAM 21 is used as a strobe input and ports $PA_0$ to $PA_7$ are programmed as input ports. Therefore, when data is read in, in accordance with this strobe signal, a busy signal is immediately transmitted to the port $PC_1$ to release the ready condition. Further, ports $P_{B0}$ to $P_{B7}$ and a port PC4 provide output signals for driving the head electromagnets.

A RAM of 256 bytes is housed in the RAM 21 and used to store the print data. The exchange of data between the RAM 21 and the CPU 22 is performed through address data busses $AD_0$ to $AD_7$. The CPU operates as the main controller of the system, as stated above, and performs all commands according to data stored in a ROM 23. The data stored in the ROM 23 is latched by a latch 24 according to an ALE signal from the CPU 22 and read into the CPU 22 through the address data bus. The data is decoded in the CPU 22.

A slave CPU 25 produces signals for the stepping motor for controlling the carriage, and for a stepping motor for controlling the sheet feeding. Driving circuits for the respective stepping motors are shown in FIG. 5.

The elements 26 (FIG. 4) are buffers which timely read in through the data bus to the CPU 22, the state of a DIP switch capable of arbitrarily changing some of the processing schedules. In the circuits of FIG. 5, a timer element 27 is capable of changing the pulse width of a current pulse to be supplied to the head electromagnets according to variations in the supply voltage. In this way, the output energy from the head electromagnets is always maintained constant although voltage varies.

The driving circuit for the carriage driving stepping motor 5 provides a holding current from a terminal SCR when there is no timing pulse detected after a predetermined time lapse after a phase change which drives the motor. A terminal SLF is also provided to switch the current supply to a holding current supply for the driving circuit of the sheet feeding stepping motor 8.

Figure 6:
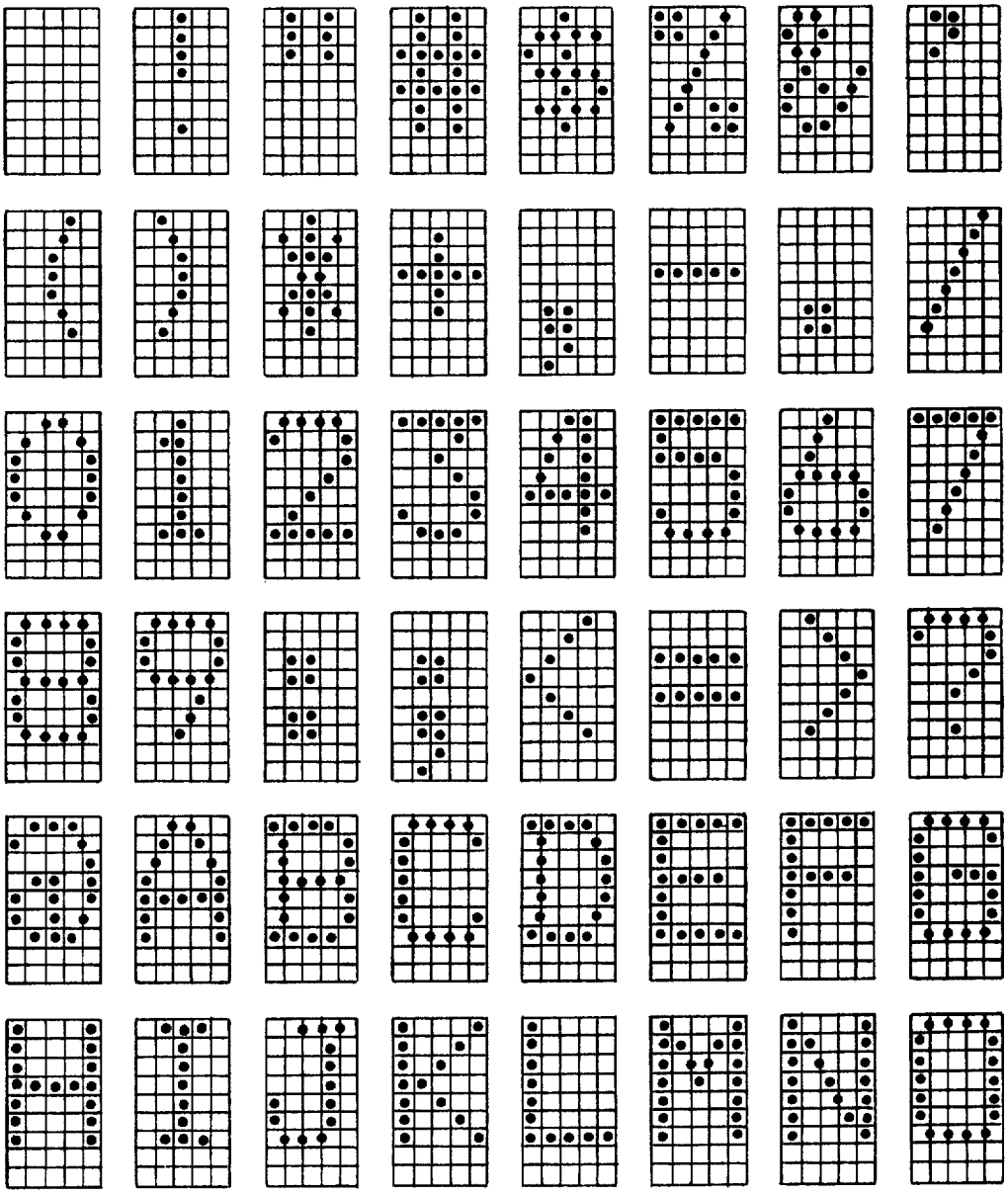
FIG. 6 PRIOR ART
FIG. 6 shows exemplary characters and symbols provided by a dot printer of the prior art using a matrix format.
Figure 7A:
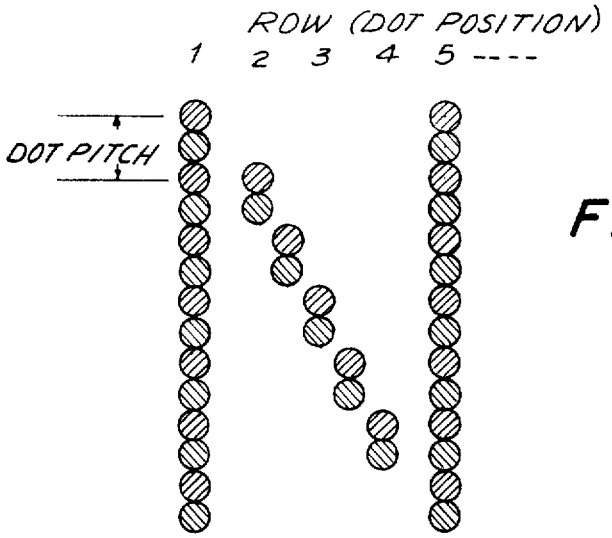
FIGS. 7*a* and 7*b* show exemplary characters provided by the method and apparatus for serial printing in accordance with this invention.
Figure 7B:
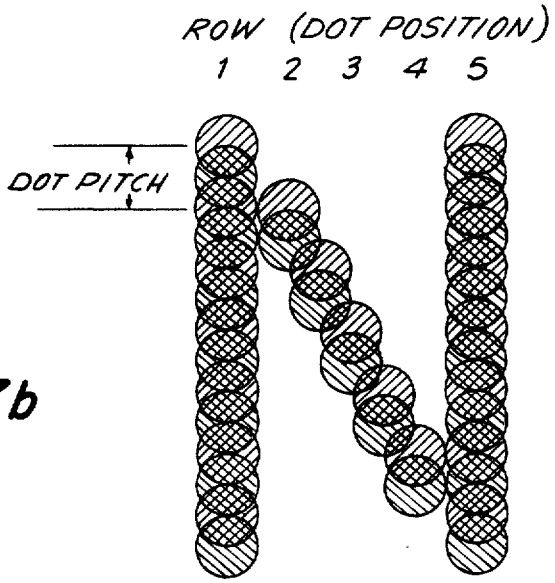

Various characters, such as shown in FIG. 6, can be printed on a basis of selected combinations of dots by the present system described above. The dots have gaps between them in the vertical direction as a result of mechanical limitations in arranging the wires or ink jet nozzles in the printer head. In accordance with the serial dot printer of this invention, any character can be made more easily readable by printing the character twice with a slight shift in the vertical direction between the first and second printing. The number of dots and their positions, that is, the dot data is identical in both printings of the same character or symbol.

In FIGS. *7a* and *7b*, the letter "N" is shown as printed in accordance with this invention. The letter "N" in FIG. *7a* is provided by shifting the head across the paper sheet transversely to the direction of paper feeding, when the head has a row of vertically arranged wires, parallel to the paper feed direction, with a relatively large pitch between adjacent wires. Thus, the dots printed in one traverse of the head, that is, the dots with shading lines in FIG. *7a* slanted from the lower left-hand corner toward the upper right-hand corner of the Figure, are spaced apart with a dot pitch between centers leaving room for another dot therebetween. In the second traverse, dots with shading lines slanting from the upper left to the lower right in the Figure are added. This is the identical pattern as was printed in the first traverse. The dots in the second traverse are vertically contiguous with the previously printed dots such that the vertical lines of the letter N are continuous.

In FIG. *7b*, the letter N is printed with a wire dot printer having a smaller dot pitch so that continuous dots are produced by the first traverse of the print head. On the next traverse, the centers of the dots are at the point of tangent contact of the first printed dots. Thus, a more dense pattern is formed, but again, the second traverse prints the identical pattern of dots using the same data as does the first traverse with a vertical displacement of half of the dot pitch distance. FIGS. *7a* and *7b* show the dots vertically arranged with the dot centers of the same traverse being two dot diameters and one dot diameter apart respectively. Obviously, dot pitch distances of different magnitudes within that range can be used without the appearance of open gaps in the vertical portions of the letter.

The letter N is usually provided by using a 5×7 dot matrix which includes the slant line positioned as shown in FIG. 6. In order to print this slanted line naturally, that is, without a great amount of waviness, a so called half dot printing technique is used in the prior art in which an additional dot line is printed between normally adjacent dot lines. That is, in the letter N of FIG. 6, it can be seen that the slanting portion includes dots which are directly centered in the squares of the matrix as well as dots which are on the lines of the matrix. In accordance with the serial printer of this invention, with or without using the half dot printing technique, the same data is printed twice with a certain shift in the vertical direction as described above.

Figure 8:
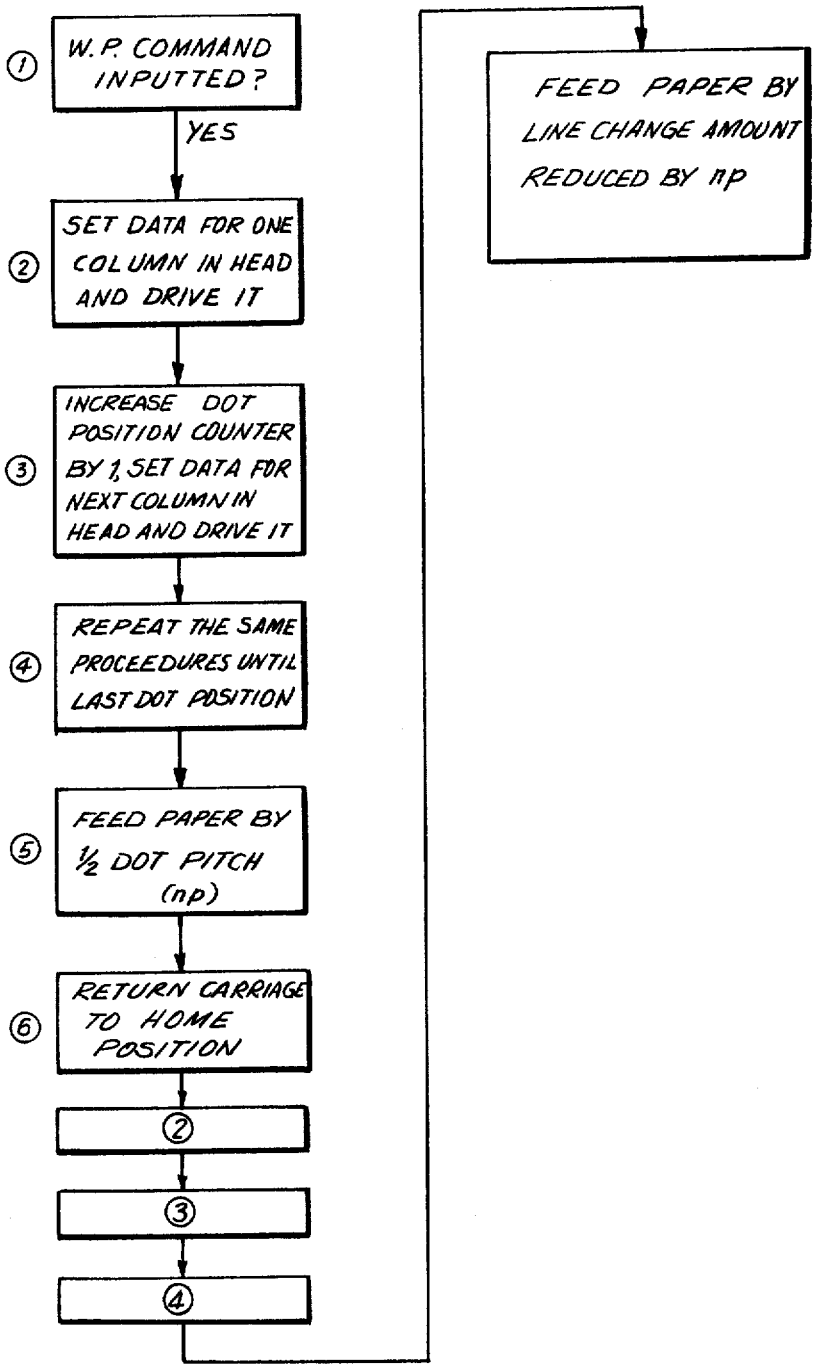
FIG. 8 is a logical flow chart for performance of serial dot printing in accordance with this invention.

The double printing of the serial printer in accordance with this invention is performed according to the process shown in FIG. 8 when the printer is instructed by a double print command (WP command) sent to the central processing unit (CPU) from the outer control unit. A WP command can be input at either of two times, that is, at the beginning of the data for one line, or in the middle of the character data. At the completion of the data for one line, either a carriage return code CR for returning the carriage to the home position or a line feed code LF for feeding the paper is conventionally input. As soon as these codes are input, the printer operates and prints very rapidly based on the data for one line. The WP command operates as a control code, as do the CR and LF codes. An optional process can be carried out by the occurrence of an escape code signal ESC and the following numeric or alphabet characters are printed in double print when an input ESC G is input. Though double printing is carried out in accordance with the input, in this case it should be understood that the designers can set up at their option whether all the data for one line is double printed or only the data after the input of the ESC G code. In accordance with the selected option, when printing of a line has finished upon the input of an ESC G code, the paper is fed ½ dot pitch distance and printing of all the data for one line is carried out again or printing on only the data after the input of the ESC G signal is carried out.

In particular, in FIG. 8, in the first step of the process (block 1), it is determined whether or not the WP command has been inputted to the CPU 22 to provide double printing. In printing the letter N, for example, in FIG. *7b*, the data is initially set so that the head is positioned at the first dot row position. In printing the letter N, all of the seven wires are driven and in accordance with the data the first row is printed (block 2). Then the head is shifted by one dot position to the right to the second dot row. The data is read and only the second wire from the top is driven and prints a dot in accordance with the data (block 3). In a similar manner, the printing of the subsequent dot row positions is performed (block 4). This completes a character and in time a line of print.

After one line of printing is completed, the head returns to the home position and simultaneously the paper sheet is fed by a half of the dot pitch distance in the direction transverse to the line which has been printed (blocks 5 and 6). The feeding of the paper by one-half of the dot pitch distance occurs when the WP command has previously been inputted (block 1). When there is no WP command inputted, the paper sheet is fed by a distance corresponding to one line spacing.

In the case where there is a WP command inputted (FIG. 8), the data used to print the preceeding line is set to the respective wires and the process shown in blocks 2 to 4 is repeated. The same data is printed twice with the dots being displaced from the originally printed dots by ½ dot pitch distance. Thus, the characters are printed with a higher density.

After the data has been printed twice, the paper is fed for a line change by a distance equal to the normal one line spacing reduced by a half of the dot pitch distance in the direction of successive printed lines on the paper.

As stated above, in a serial printer in accordance with this invention, the characters which include a slant line portion, e.g. N, can be printed using both the double printing technique of this invention and the half dot printing technique which has been used in the prior art. As a result, the slanted portion of the character is printed as a substantially solid line which greatly improves the readability of the character or symbol.

Another feature of a serial printer in accordance with this invention is the method of feeding paper. The power source for feeding paper depends on the stepping motor 8 which feeds the paper in steps by a predetermined distance. In the serial dot printer in accordance with this invention, the sprocket wheels 7 are set to feed the recording paper 3 by a distance of ⅓ of the dot pitch distance in the vertical direction of the printed characters, that is, in the direction that the paper is fed.

Figure 9:
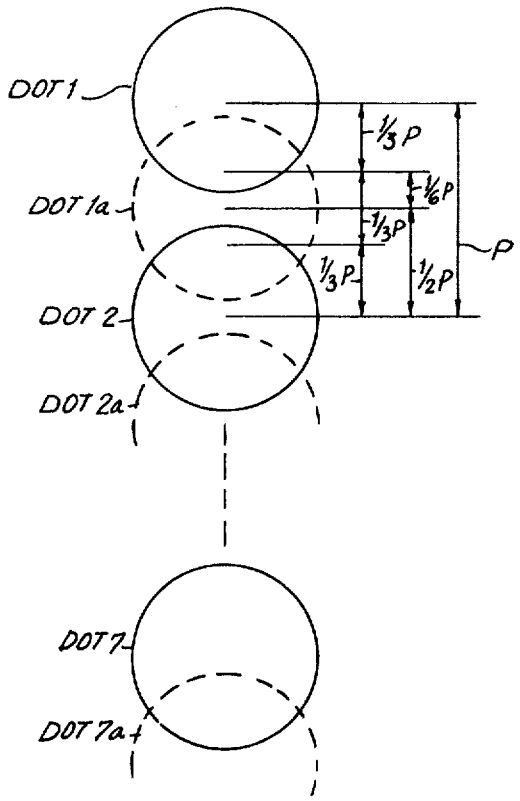
FIG. 9 is a diagram of dots to a much enlarged scale showing the positional relationships between dots printed in a first and a second traverse.

As shown in FIG. 9, dots 1 through 7 in the same vertical line are printed by seven wires in the print head. The distance P between the wires and dots is properly maintained in accordance with the spacing of the wires in the head. As shown in the example of FIG. 9, the dots 1 and 2 are not in contact but the space between them is not sufficient to receive therein an additional dot without some overlapping. When printing in the double printing method, when the recording sheet is advanced by one-half of the dot distance P and the wires in the head are operated again using the same data as used in printing dots 1–7, the dots 1*a* to 7*a* are printed. Desirably, the printing of the vertical columns comprised of dots 1–7 and dots 1*a*–7*a* is completed.

Figure 10:
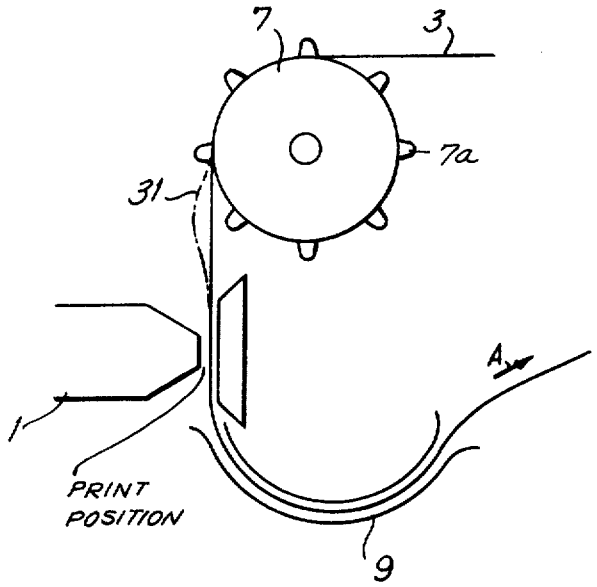
FIG. 10 is a schematic illustration of the printing mechanism of the serial dot printer of FIG. 1, showing a paper feeding construction.

However, as shown in FIG. 10, when the recording sheet 3 is fed intermittently, that is, step-wise, when the sprocket wheel 7 stops, the paper is fed excessively because of inertia. The paper bends or flexes above the printing position as shown by the broken line 31. When a full force is applied to the recording sheet 3 in the direction of arrow A before it reaches the printing position, the recording sheet feeds without flexing or bending. However, when too much force is applied to the recording sheet 3, the perforations in the recording sheet are broken by the pins of the sprocket wheels 7 and ultimately the recording sheet 3 cannot be fed at all. Therefore, the recording sheet 3 is restrained by a paper restrainer, or the like, to such a degree that it cannot bend at the printing position or in the position of the paper guide 9.

It has been determined experimentally, that the length of the paper 3 which causes the flexing is in the order of 1/6 of the dot pitch distance. Therefore, when it is desired to center the second dot at the midpoint of the dot pitch distance, that is, dot 1*a* is equally between dots 1 and 2, the driving signals to the sprocket wheel is adapted to provide a rotation suitable for a step of ⅓ of the dot pitch distance. When this is done, and after the inertia effects, the sprocket wheel stops with the recording sheet fed by the desired ½ of the dot pitch distance.

Thereby, printing is properly carried out in the position offset by ½ of the pitch distance of the wires and of the dots printed in the same traverse. Good quality of print is produced.

This paper feeding feature is effective not only for the serial dot printer in accordance with this invention for printing the same character information twice, but it is also effective in all applications of printing in positions which differ in pitch from the pitch of the plurality of wires.

As previously stated, the method in accordance with this invention can be applied to printer heads including wires or ink nozzles, and in thermal printers.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

What is claimed is:

1. A method of printing high quality alphanumeric characters and symbols on a recording sheet using a printer head, said printed indicia being formed by a plurality of dots, said print head including a plurality of means for producing individual dots aligned in at least one column, said aligned dots and plurality of means for producing individual dots having a fixed pitch distance between them, said printer head responding to control means and operating on stored data contained in data storage means for a line of print; comprising the steps:

(a) monitoring a double print command supplied from said control means;

(b) driving selected ones of said plurality of means for producing dots in at least one column in a pattern determined by said stored data to produce at least a portion of a selected symbol or character with printed dots on said recording sheet;

(c) laterally translating said head partially across said recording sheet in a direction transverse to said at least one column;

(d) performing steps (b) and (c) repetitively until a line of printed characters or symbols is completed on said recording sheet;

(e) feeding said recording sheet in a direction parallel to said at least one column by a distance corresponding to about half of said pitch distance, said feeding of said recording sheet being in response to said double print command; and (f) repeating steps (b) through (d) using the same stored data read out of the same locations of said data storage means and driving the same selected ones of said plurality of means for producing dots for the same lateral positions of said head and printed dots, the identical dot pattern being printed a second time.

2. A method as claimed in claim 1, and further comprising the step:

(g) moving said head and recording sheet relative to each other in a direction parallel to said at least one column by a line space distance less the distance of relative moving in step (e);

(h) repeating steps (a) through (g) until printing of lines of said characters and symbols is complete.

3. A method of dot printing high quality alphanumeric characters or symbols on a recording sheet from stored data for a line of print by using control means and a printer head including a plurality of means for producing individual dots aligned in at least one column, said head being adapted to produce dots having centers separated along said at least one column by a selected pitch distance, and paper feeding means including a stepping motor for incrementally feeding said recording sheet in the direction of said at least one column, an electrical driving signal applied to said motor moving said sheet one increment equal to approximately half of said dot pitch distance, comprising the steps:

(a) monitoring a double print command supplied from said control means;

(b) setting selected data for dot positions from said stored data in said print head;

(c) driving selected ones of said plurality of means for producing dots of said print head according to said set data to print dots on said recording sheet;

(d) moving said print head laterally in stepwise increments in a direction away from a home position transversely to said recording sheet;

(e) repeating steps (b), (c), (d) at a plurality of transverse dot positions until one line of print is completed;

(f) feeding said recording sheet by a distance corresponding to said approximately half of said dot pitch distance by applying an electrical driving signal to said stepping motor;

(g) repeating steps (b) through (e) using the same set data and driving the same selected ones of said plurality of means for producing dots for the same transverse dot positions at each stepwise increment respectively of said print head; the identical dot pattern being printed a second time, said identical dot patterns being separated in the paper-feeding direction by the feeding distance of step (f), and (h) feeding said recording sheet for a line change by a distance equal to the normal one line spacing reduced by a distance corresponding to said feeding of step (f).

4. A method of dot printing high quality alphanumeric characters or symbols on a recording sheet from coded data for a line of print using control means and a printer head including a plurality of means for producing individual dots aligned in at least one column and adapted to produce dots having centers separated along said at least one column by a selected pitch distance, and paper feeding means including a stepping motor, said paper feeding means incrementally feeding said recording sheet in the direction of said at least one column by approximately half of said dot pitch distance in one said step produced by one electrical driving signal applied to said motor, comprising steps:

(a) monitoring a double print command supplied from said control means;

(b) setting selected data for dot positions in said print head;

(c) driving selected ones of said plurality of means for producing dots of said print head according to said set data to print dots on said recording sheet;

(d) moving said print head laterally in a stepwise increment in a direction away from a home position transversely to said recording sheet;

(e) repeating steps (b), (c), (d) at a plurality of dot positions until one line of print is completed;

(f) feeding said recording sheet by a distance corresponding to approximately half of said dot pitch distance by applying one electrical driving signal to said motor, (g) returning said print head to said home position;

(h) repeating steps (b) through (e) using only the data set after the input of said double print command for the same transverse dot positions and driving the same selected ones of said plurality of means for producing dots at each stepwise increment respectively of said print head, said double print command occurring during the performance of step (e), the dot pattern printed after said double print command being identically printed a second time, said identical dot patterns being separated in the paper feeding direction by the feeding distance of step (f);

(i) feeding said recording sheet for a line change by a distance equal to the normal one line spacing reduced by a distance corresponding to the feed of said one step of said stepping motor.

5. A serial dot printer for printing alphanumeric characters and symbols with dot patterns on a recording sheet, comprising:

a printing head including a plurality of means for producing individual dots on said recording sheet, said means for producing dots being aligned in at least one column and adapted to produce dots having centers separated along said at least one column by a selected pitch distance;

carriage means for translating said print head across said recording sheet in directions transverse to said at least one column;

data storage means for holding selected data for printing dot patterns for a line of said characters and symbols during translation of said carriage means;

paper feeding means for incrementally driving said recording paper in the direction of said at least one column by a fractional portion of said pitch distance;

control means for controlling said head and carriage means and for actuating said feeding means to move said recording paper by said fractional portion of said dot pitch distance, said control means operating in response to a double print command, the same data for printing a complete line of said characters and symbols being read out of the same locations of said data storage means in each of two traverses of said carriage, the same dot patterns for said complete line being printed at the same transverse positions of said carriage in each of said two traverses, the same selected ones of said plurality of means for producing individual dots being driven at the same transverse positions of said carriage in each said traverse, the printing during the first one of said two traverses being completed prior to said feeding of said paper by said fractional portion of said dot pitch distance, the second of said two printings occurring during the second one of said two traverses following said feeding of said paper by said fractional portion of said dot pitch distance, said two printings being displaced one from the other by said fractional portion of dot pitch distance, every dot of said complete line, whether comprising a vertical or non-vertical portion of a character or symbol printed during said first traverse, being reprinted in said second traverse.

6. The dot serial printer as claimed in claim 5, wherein said paper feeding means includes a stepping motor, approximately $\frac{1}{2}$ of the dot pitch distance being traveled by said sheet in one step produced by one electrical driving signal in said motor, said signal driving said motor by one step corresponding to $\frac{1}{3}$ of said dot pitch distance, the remainder of said $\frac{1}{2}$ pitch distance of paper feeding resulting from the inertia of said paper feeding means.

7. The dot serial printer as claimed in claim 6 or 5, wherein said control means is further adapted to actuate said paper feeding means to feed said paper over a predetermined distance less a distance of ½ of said dot pitch distance whereby line spacing is provided.

8. The dot serial printer as claimed in claim 7, wherein said control means is further adapted to actuate said paper feeding means to feed said paper over said predetermined distance after one carriage traverse, whereby the same line spacing is provided whether or not double printing is performed.

* * * * *